US009383136B2

(12) United States Patent
Zhang et al.

(10) Patent No.: US 9,383,136 B2
(45) Date of Patent: Jul. 5, 2016

(54) SUBSTRATE DRY DEVICE AND METHOD FOR DRYING SUBSTRATE BASED ON SUBSTRATE DRY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Xiaoxiang Zhang, Beijing (CN); Zongjie Guo, Beijing (CN); Zheng Liu, Beijing (CN); Shoukun Wang, Beijing (CN); Mingxuan Liu, Beijing (CN)

(73) Assignees: BOE TECHNOLOGY GROUP CO. LTD.; BEIJING BOE DISPLAY TECHNOLOGY CO., LTD.

( * ) Notice: Subject to any disclaimer, the term of this patent is extended or adjusted under 35 U.S.C. 154(b) by 0 days.

(21) Appl. No.: 14/495,247

(22) Filed: Sep. 24, 2014

(65) Prior Publication Data

US 2015/0338163 A1 Nov. 26, 2015

(30) Foreign Application Priority Data

May 22, 2014 (CN) ..... 2014 1 0219334

(51) Int. Cl.
*B08B 3/12* (2006.01)
*F26B 5/00* (2006.01)
(Continued)

(52) U.S. Cl.
CPC ... *F26B 5/00* (2013.01); *F26B 5/14* (2013.01); *F26B 15/20* (2013.01); *F26B 21/004* (2013.01); *F26B 21/14* (2013.01)

(58) Field of Classification Search
CPC ..... H01L 21/67; H01L 21/02; F26B 5/00; F26B 15/20
USPC ..... 134/18, 57 R, 42, 30, 102.3
See application file for complete search history.

(56) References Cited

U.S. PATENT DOCUMENTS 5,369,891 A 12/1994 Kamikawa
6,109,278 A * 8/2000 Shindo et al. ..... 134/56 R
(Continued)

FOREIGN PATENT DOCUMENTS

CN 1938830 A 3/2007
CN 1963992 A 5/2007
(Continued)

OTHER PUBLICATIONS

Office Action in Chinese Patent Application No. 201410219334.8, dated Jun. 16, 2015.

*Primary Examiner* — Caleb Henry
(74) *Attorney, Agent, or Firm* — Baker Hostetler LLP

(57) ABSTRACT

The present invention provides a substrate dry device and a method for drying the substrate, the substrate dry device comprises a cavity, dry bars and a sensor disposed on the top of the cavity, liquid immerging the substrate is accommodated within the cavity, with the dry bars comprising a first dry bar and a second dry bar arranged parallel to each other, with a gap is formed therebetween and with the sensor disposed on one end or on two ends of the gap for monitoring a position in which the substrate is moved away from the liquid. By use of the above arrangement, the gas is ejected through the dry bars to the surface of the substrate which has moved away from the liquid, the tension of the surface of the liquid film on the substrate is changed by marangori effect under the action of the gas and the surface tension gradient of the liquid film makes the liquid film shrink so that the surface of the substrate becomes dry.

18 Claims, 2 Drawing Sheets

(51) Int. Cl.

| | |
|---|---|
| ***F26B 15/20*** | (2006.01) |
| ***F26B 5/14*** | (2006.01) |
| ***F26B 21/00*** | (2006.01) |
| ***F26B 21/14*** | (2006.01) |

(56) References Cited

U.S. PATENT DOCUMENTS

| | | | | |
|---|---|---|---|---|
| 2001/0037822 | A1* | 11/2001 | Elsawy et al. | 134/30 |
| 2005/0011537 | A1* | 1/2005 | Toshima et al. | 134/19 |
| 2009/0084413 | A1* | 4/2009 | Lewis et al. | 134/30 |
| 2010/0051068 | A1* | 3/2010 | Miyanari | 134/95.2 |
| 2011/0012635 | A1* | 1/2011 | Lu et al. | 324/757.03 |
| 2012/0327428 | A1* | 12/2012 | Hellwig et al. | 356/614 |
| 2013/0061888 | A1* | 3/2013 | Sato | 134/95.2 |
| 2013/0160938 | A1* | 6/2013 | Yasui et al. | 156/246 |
| 2014/0302676 | A1* | 10/2014 | Miyazaki et al. | 438/692 |
| 2015/0090299 | A1* | 4/2015 | Brown et al. | 134/21 |
| 2015/0122291 | A1* | 5/2015 | Yen et al. | 134/18 |
| 2015/0158056 | A1* | 6/2015 | Rastegar | 134/1 |

FOREIGN PATENT DOCUMENTS

| | | | |
|---|---|---|---|
| CN | 102768972 | A | 11/2012 |
| CN | 103792961 | A | 5/2014 |
| JP | 2005-093899 | A | 4/2005 |

* cited by examiner

SUBSTRATE DRY DEVICE AND METHOD FOR DRYING SUBSTRATE BASED ON SUBSTRATE DRY DEVICE

CROSS REFERENCE TO RELATED APPLICATION

This application claims priority to Chinese Patent Application No. 201410219334.8 filed on May 22, 2014, the disclosures of which are incorporated in their entirety by reference herein.

TECHNICAL FIELD

The present invention relates to the field of the liquid crystal display, especially relates to a substrate dry device and a method for drying the substrate.

BACKGROUND

Recently in the field of a liquid crystal display processing, in a substrate manufacturing procedure, generally a display panel is obtained by means of fabricating an array substrate and a color substrate by forming a circuit pattern or a color filter (CF) on a glass substrate firstly, dripping liquid crystal on the array substrate or the color substrate, and then ceiling the array substrate and the color substrate. Commonly, before fabricating the circuit pattern and the color filter on the glass substrate, it is necessary to perform liquid medicine processing such as development and etching or the like for the glass substrate.

Before performing the liquid medicine processing or after performing the liquid medicine processing for the substrate, the substrate must be cleaned by washing liquid such as pure water or the like, it also needs to perform drying processing on the cleaned substrate in order to perform the following process normally. In the prior art, the implement used mostly for the dry process for the substrate is moving the substrate by a move device such as a drum type move device or the like, and performing cleaning processing and drying processing simultaneously. In the process of the dry processing for the substrate, the glass substrate is dried by high pressure dry air ejected by the air knife, thereby the washing liquid is cleaned and removed from the surface of the substrate.

Drying the substrate by using an air knife can realize the drying for the substrate on one hand, but on the other hand, high pressure air ejected from the air knife tends to cause abscission or partial deficiency for the photoresist on the surface of the glass substrate, and cause the etched substrate has defects after etching, and the product percent of pass is reduced.

SUMMARY

1. Technical Problems to be Solved

The technology problems of the present invention to be solved is how to avoid the defects on the surface of the substrate caused in the drying processing for the substrate and how to increase the product percent of pass.

2. Technical Solution

To solve the above mentioned problems, the present invention provides a substrate dry device, comprising a cavity, and dry bars and a sensor which are disposed on the top of the cavity, liquid immerging the substrate is accommodated within the cavity;

the dry bars are used for drying the substrate which has moved away from the liquid, the dry bars comprises a first dry bar and a second dry bar arranged parallel to each other, a gap is formed between the first dry bar and the second dry bar, the sensor is disposed on one end or on two ends of the gap for monitoring a position in which the substrate is moved away from the liquid.

Alternatively, the sensor, the sensor, the first thy bar and the second dry bar are in the same horizontal position.

Alternatively, pinholes are disposed on the first dry bar and the second dry bar in the direction of facing the gap, and gas is ejected through the pinholes to the substrate in the gap.

Alternatively, the shape of the gap is a long strip, and the width of the gap is larger than the thickness of the substrate.

Alternatively, guide rails are disposed on the two sides of the substrate inside the cavity, and the substrate moves along the guide rails.

Alternatively, one end of the guide rail closing to the top of the cavity is connected to a side wall of the cavity through a pivoting structure, the range of the inclination angle between the guide rail and the vertical direction is 0~90°.

Alternatively, the end of the guide rail closing to the top of the cavity is inclined to the left side or the right side relative to the vertical direction through the pivoting structure.

Alternatively, a push rod is disposed inside the cavity, for providing thrust for the movement of the substrate under the control of a motor outside the cavity.

Alternatively, a liquid injection pipe is disposed on a side wall of the cavity, and a liquid exhaust pipe is disposed on the bottom of the cavity, thereby the cycle of the liquid in the cavity is realized.

Alternatively, the gas ejected from the dry bars is mixed gas of N2 and isopropyl alcohol.

Alternatively, the pressure of the mixed gas is higher than the standard atmosphere, within the range of 1~1.5 Pa.

Alternatively, the range of the flow rate of the N2 in the mixed gas is 5~20 sccm, and the range of the flow rate of the isopropyl alcohol is 0.1~0.7 sccm.

Alternatively, further comprises a gas passage which is connected to the first dry bar and the second dry bar, for transmitting the gas to the first dry bar and the second dry bar.

To solve the above mentioned problems, the present invention also provides a method for drying the substrate based on the above substrate dry device, comprising:

the substrate gradually moving away from the liquid under the action of the thrust force, when the sensor senses that the substrate moves away from the liquid, the first dry bar and the second dry bar located on two sides of the substrate eject the gas to the surface of the substrate, and meanwhile the substrate continues moving away from the liquid under the action of the thrust, the tension of the surface of the liquid film on the substrate being changed by marangori effect under the action of the gas, the surface tension gradient of the liquid film making the liquid film shrink, and realizing the dry of the surface of the substrate.

Alternatively, when the sensor senses that the substrate has entirely moved away from the liquid, the gas is stopped from ejecting.

3. Technical Effects

An embodiment of the present invention provides a substrate dry device, comprising a cavity, and dry bars and a sensor which are disposed on the top of the cavity, liquid immerging the substrate is accommodated within the cavity; the dry bars are used for drying the substrate which has moved away from the liquid, the dry bars comprises a first dry bar and a second dry bar arranged parallel to each other, a gap is formed between the first dry bar and the second dry bar, the sensor is disposed on one end or on two ends of the gap for monitoring a position in which the substrate is moved away from the liquid. By means of using the above mentioned substrate dry device, the gas is ejected through the dry bars to the surface of the substrate which has moved away from the liquid, the tension of the surface of the liquid film on the substrate is changed by marangori effect under the action of the gas, the surface tension gradient of the liquid film makes the liquid film shrink, and the dry of the surface of the substrate is realized, this will not cause defects on the surface of the substrate and the substrate product percent of pass will be increased. Also, the present invention provides a method for drying the substrate based on the above substrate dry device.

Figure 1:
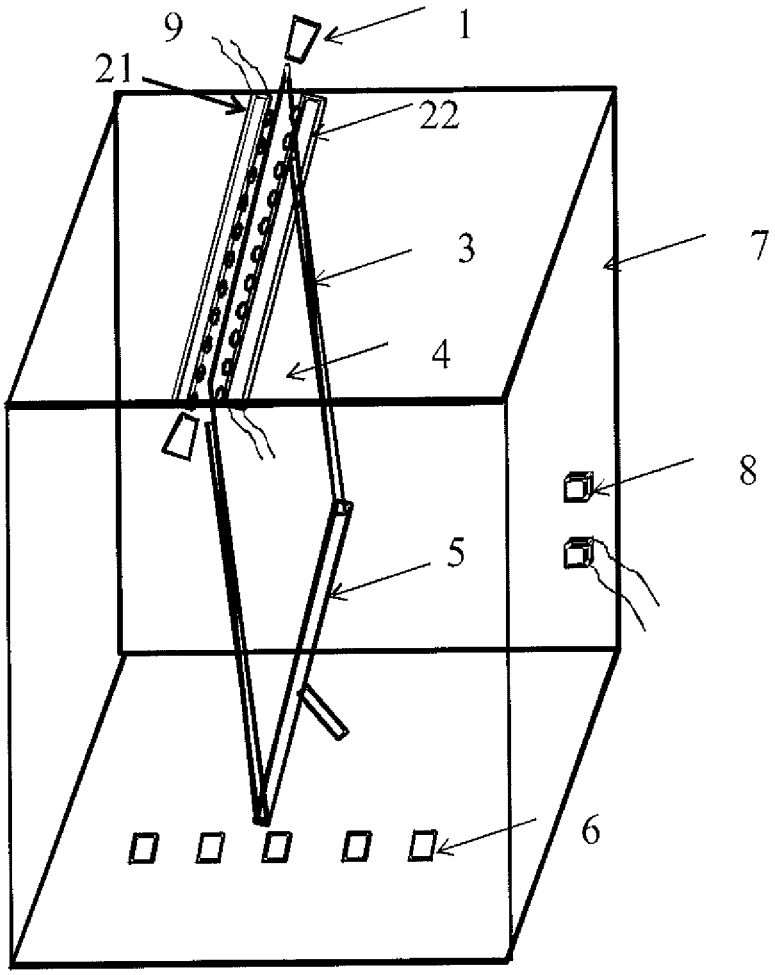
FIG. 1 shows a structural view of a substrate dry device provided by a first embodiment of the present invention.

1: sensor; 21: a first dry bar; 22: a second dry bar; 3: a guide rail; 4: a substrate; 5: a push rod; 6: a liquid exhaust pipe; 7: a cavity; 8: a liquid injection pipe; 9: an gas passage.

DETAILED DESCRIPTION

The detailed implementations of the present invention will be described referring to the drawings and the embodiments, and the following embodiments are used to illustrate the present invention, but not used to limit the scope of the present invention.

A First Embodiment

A substrate 4 dry device is provided in the first embodiment of the present invention, a structural view of which is shown in FIG. 1, the substrate dry device comprises a cavity 7, and dry bars and a sensor 1 which are disposed on the top of the cavity 7, liquid immerging the substrate 4 is accommodated within the cavity 7.

The dry bars are used for drying the substrate 4 which has moved away from the liquid, the dry bars comprises a first dry bar 21 and a second dry bar 22, a gap is formed between the first dry bar 21 and the second dry bar 22, the sensor 1 is disposed on one end or on two ends of the gap for monitoring a position in which the substrate 4 is moved away from the liquid.

The substrate dry device no longer dries the surface of the substrate by directly using the air knife by making improvements on the structure of the existing substrate dry device, by monitoring the position in which the substrate is moved away from the liquid by the sensor, when it is monitored that the substrate has moved away from the liquid, the substrate is dried by the gas ejected from the dry bars on two sides of the substrate, thereby the defect on the surface of the substrate caused by the high pressure gas is avoided.

Further, the sensor 1, the first dry bar 21 and the second dry bar 22 of the embodiment are in the same horizontal position. In which the number of the sensor is one or two, FIG. 1 takes two sensors as an example, i.e. two sensors are disposed on two ends of the gap respectively to monitor the position in which the substrate 4 is moved away from the liquid. However, only one sensor is disposed on one end of the gap in the other embodiments of the present invention, which also can monitor the position in which the substrate is moved away from the liquid, therefore the number of the sensor can be one or two.

Further, in the present embodiment, pinholes are disposed on the first dry bar 21 and the second dry bar 22 in the direction of facing the gap, and gas is ejected through the pinholes to the substrate 4 in the gap. The gas ejected from the dry bars dry the substrate on the surface of the substrate, it is better if the gas flows slow, the occurrence of flow of the unsolidified liquid under the action of blast air can be avoided and the destructive effect on forming the liquid film of the surface of the substrate can be avoided.

Further, the shape of the gap in the present embodiment is a long strip, and the width of the gap is larger than the thickness of the substrate 4. The long strip shaped gap between the two dry bars is a passage through which the substrate moves upward gradually and moves away from the liquid, therefore the width of the gap should be larger than the thickness of the substrate.

Further, guide rails 3 are disposed on the two sides of the substrate 4 inside the cavity 7 in the present embodiment, and the substrate 4 moves along the guide rails 3. Further more, one end of the guide rail 3 closing to the top of the cavity 7 is connected to a side wall of the cavity 7 through a pivoting structure, the range of the inclination angle between the guide rail 3 and the vertical direction is 0~90°. The substrate moves along the guide rails in the course of leaving the liquid, however, the substrate can move away from the liquid along the vertical direction or in a inclination way, hence the end of the guide rail closing to the top of the cavity is movably connected, i.e. inclination occurs by means of the pivoting structure, and it can incline to the left side or the right side relative to the vertical direction.

Further, a push rod 5 is disposed inside the cavity 7 in the present embodiment, for providing thrust for the movement of the substrate 4 under the control of a motor outside the cavity 7. The substrate can always move along the direction parallel to the gap and the uniformity of the surface of the substrate when being dried by the gas can be guaranteed by means of providing uniform thrust by the push rod for the movement of the substrate.

Further, a liquid injection pipe 8 is disposed on a side wall of the cavity 7 in the present embodiment, and a liquid exhaust pipe 6 is disposed on the bottom of the cavity 7, thereby the cycle of the liquid in the cavity is realized. Note that before drying the substrate, it is often to wash the substrate by putting the substrate in the Deionized Water (DIW).

Further, the gas ejected from the dry bars in the present embodiment is mixed gas of N2 and isopropyl alcohol (IPA). Note that the pressure of the mixed gas is higher than the standard atmosphere, within the range of 1~1.5 Pa. Because the pressure of the mixed gas for drying the substrate is slightly larger than the standard atmosphere and much smaller than the pressure of high pressure gas ejected from the air knife in the prior art, the abscission of the liquid film on the surface of the substrate in the process of drying by the high pressure gas ejected from the air knife for the surface of the substrate will be avoided, and the occurrence of the defects will be avoided.

Specifically, the range of the flow rate of the N2 in the mixed gas is 5~20 sccm, and the range of the flow rate of the isopropyl alcohol is 0.1~0.7 sccm, In which the seem is a volume flow unit, with English meaning of standard-state cubic centimeter per minute. The obtained mixed gas mixed according to the above method is taken as the dry gas to dry the surface of the substrate in the present embodiment.

Further, the substrate dry device comprises a gas passage 9 which is connected to the first dry bar 21 and the second dry bar 22, for transmitting the gas to the first dry bar 21 and the second dry bar 22. The detailed structure of the gas passage is not shown in FIG. 1, and the connected relation between the gas passage and the dry bars is just schematically shown in the FIG. 1. The N2 and the isopropyl alcohol are mixed at the other end of the gas passage, the mixed gas is entered into the gas passage, and then ejected from the pinholes of the dry bars.

In summary, the substrate dry device provided by the present embodiment takes mixed gas of N2 and isopropyl alcohol as dry gas, ejects the dry gas through the pinholes on the dry bars to the surface of the substrate which has moved away from the liquid, and changes the tension of the liquid film on the surface of the substrate by marangoni effect, the marangoni effect is a kind of thermo physics effect, when the liquid film of a kind of liquid becomes thinner partially under the external disturbance such as temperature, concentration, marangoni flow will be formed under the gradient effect of the surface tension, which will lead the liquid flow back to the thin liquid level along a best path, with this structure to dry the substrate will not cause defects on the surface of the substrate and the substrate product percent of pass will be increased.

A Second Embodiment

Based on the above, a second embodiment of the present invention further provides a method for drying the substrate based on the substrate dry device of the first embodiment, the method comprises:

The substrate gradually moving away from the liquid under the action of the thrust force, when the sensor senses that the substrate moves away from the liquid, the first dry bar and the second dry bar located on two sides of the substrate eject the gas to the surface of the substrate, and meanwhile the substrate continues moving away from the liquid under the action of the thrust, the tension of the surface of the liquid film on the substrate being changed by marangori effect under the action of the gas, the surface tension gradient of the liquid film making the liquid film shrink, and realizing the dry of the surface of the substrate.

Further, when the sensor senses that the substrate has entirely moved away from the liquid, the gas is stopped from ejecting.

Figure 2:
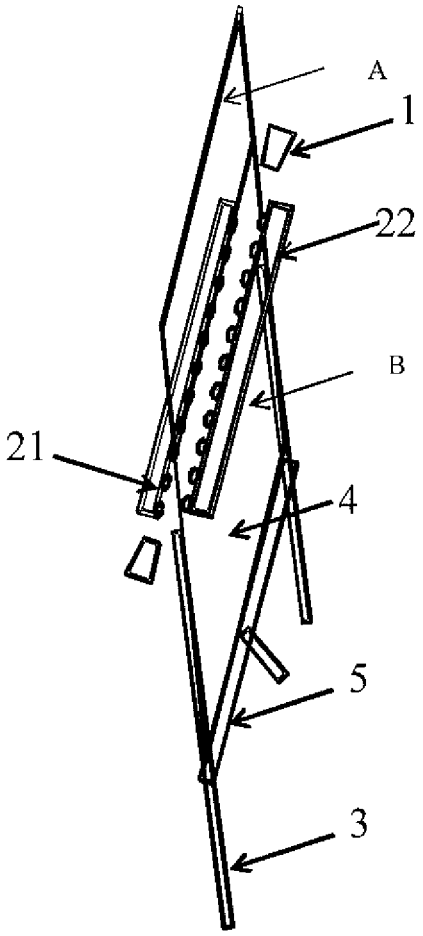
FIG. 2 shows a schematic view of a procedure of drying a substrate by a method for drying the substrate according to a second embodiment of the present invention.

According to the above, a schematic view of a procedure of drying the substrate by the substrate dry device in the first embodiment is shown in FIG. 2, in which an area above the dry bars on the substrate is a dry area, i.e. an area undertakes the dry process by the mixed gas, the dry area is indicated by "A" in FIG. 2, an area below the dry bars is a wet area, i.e. an area does not undertake the dry process by the mixed gas, the wet area is indicated by "B" in FIG. 2.

The above mentioned embodiments are made in order to explain the present invention but not to limit thereto, it should be pointed out that improvement and replacement also can be made under the premise of without departing from the technical principle and scope of the present invention to those skilled in the art, and these improvement and replacement should be seen as the protection scope of the present invention as well, the protection scope of the present invention is defined by the claims.

What is claimed is:

1. A substrate dry device, comprising a cavity, and dry bars and a sensor which are disposed on the top of the cavity, liquid immerging the substrate is accommodated within the cavity;

the dry bars are used for drying the substrate which has moved away from the liquid, the dry bars comprises a first dry bar and a second dry bar arranged parallel to each other, a gap is formed between the first dry bar and the second dry bar, the sensor is disposed on one end or on two ends of the gap for monitoring a position in which the substrate is moved away from the liquid, wherein the sensor, the first dry bar and the second dry bar are in the same horizontal position.

2. The substrate dry device according to claim 1, wherein pinholes are disposed on the first dry bar and the second dry bar in the direction of facing the gap, and gas is ejected through the pinholes to the substrate in the gap.

3. The substrate dry device according to claim 1, wherein the shape of the gap is a long strip, and the width of the gap is larger than the thickness of the substrate.

4. The substrate dry device according to claim 1, wherein guide rails are disposed on the two sides of the substrate inside the cavity, and the substrate moves along the guide rails.

5. The substrate dry device according to claim 4, wherein one end of the guide rail closing to the top of the cavity is connected to a side wall of the cavity through a pivoting structure, the range of the inclination angle between the guide rail and the vertical direction is 0~90°.

6. The substrate dry device according to claim 4, wherein the end of the guide rail closing to the top of the cavity is inclined to the left side or the right side relative to the vertical direction through the pivoting structure.

7. The substrate dry device according to claim 5, wherein the end of the guide rail closing to the top of the cavity is inclined to the left side or the right side relative to the vertical direction through the pivoting structure.

8. The substrate dry device according to claim 1, wherein a push rod is disposed inside the cavity, for providing thrust for the movement of the substrate under the control of a motor outside the cavity.

9. The substrate dry device according to claim 1, wherein a liquid injection pipe is disposed on a side wall of the cavity, and a liquid exhaust pipe is disposed on the bottom of the cavity, thereby the cycle of the liquid in the cavity is realized.

10. The substrate dry device according to claim 1, wherein the gas ejected from the dry bars is mixed gas of N2 and isopropyl alcohol.

11. The substrate dry device according to claim 10, wherein the pressure of the mixed gas is higher than the standard atmosphere, within the range of 1~1.5 Pa.

12. The substrate dry device according to claim 10, wherein the range of the flow rate of the N2 in the mixed gas is 5~20 sccm, and the range of the flow rate of the isopropyl alcohol is 0.1~0.7 sccm.

13. The substrate dry device according to claim 11, wherein the range of the flow rate of the N2 in the mixed gas is 5~20 sccm, and the range of the flow rate of the isopropyl alcohol is 0.1~0.7 sccm.

14. The substrate dry device according to claim 1, further comprising a gas passage which is connected to the first dry bar and the second dry bar, for transmitting the gas to the first dry bar and the second dry bar.

15. A method for drying the substrate based on the substrate dry device according to claim 1, comprising:

the substrate gradually moving away from the liquid under the action of the thrust force, when the sensor senses that the substrate moves away from the liquid, the first dry bar and the second dry bar located on two sides of the substrate eject the gas to the surface of the substrate, and meanwhile the substrate continues moving away from the liquid under the action of the thrust, the tension of the surface of the liquid film on the substrate being changed by marangori effect under the action of the gas, the surface tension gradient of the liquid film making the liquid film shrink, and realizing the dry of the surface of the substrate.

16. The method for drying the substrate according to claim 15, wherein when the sensor senses that the substrate has entirely moved away from the liquid, the gas is stopped from ejecting.

17. A substrate dry device, comprising a cavity, and dry bars and a sensor which are disposed on the top of the cavity, liquid immerging the substrate is accommodated within the cavity;

the dry bars are used for drying the substrate which has moved away from the liquid, the dry bars comprises a first dry bar and a second dry bar arranged parallel to each other, a gap is formed between the first dry bar and the second dry bar, the sensor is disposed on one end or on two ends of the gap for monitoring a position in which the substrate is moved away from the liquid, wherein the gas ejected from the dry bars is mixed gas of N2 and isopropyl alcohol, the pressure of the mixed gas is higher than the standard atmosphere, within the range of 1~1.5 Pa.

18. A substrate dry device, comprising a cavity, and dry bars and a sensor which are disposed on the top of the cavity, liquid immerging the substrate is accommodated within the cavity;

the dry bars are used for drying the substrate which has moved away from the liquid, the dry bars comprises a first dry bar and a second dry bar arranged parallel to each other, a gap is formed between the first dry bar and the second dry bar, the sensor is disposed on one end or on two ends of the gap for monitoring a position in which the substrate is moved away from the liquid, wherein the gas ejected from the dry bars is mixed gas of N2 and isopropyl alcohol, the range of the flow rate of the N2 in the mixed gas is 5~20 sccm, and the range of the flow rate of the isopropyl alcohol is 0.1~0.7 sccm.

* * * * *